United States Patent [19]

Valliere

[11] 4,290,277

[45] Sep. 22, 1981

[54] AIR-CONTROLLED NEEDLE LATCH CLOSING FOR KNITTING MACHINE

[75] Inventor: Robert Valliere, Laconia, N.H.

[73] Assignee: Scott & Williams, Incorporated, Laconia, N.H.

[21] Appl. No.: 50,801

[22] Filed: Jun. 21, 1979

[51] Int. Cl.[3] ..... D04B 9/24; D04B 15/08

[52] U.S. Cl. ..... 66/24; 66/111

[58] Field of Search ..... 66/24, 111, 199

[56] References Cited

U.S. PATENT DOCUMENTS

| | | | |
|---|---|---|---|
| 2,240,761 | 5/1941 | Cloutier | 66/24 |
| 2,658,366 | 11/1953 | Shelmire | 66/111 |
| 2,714,298 | 8/1955 | Crawford | 66/24 |
| 4,033,149 | 7/1977 | Avalle | 66/111 |

FOREIGN PATENT DOCUMENTS

| | | | |
|---|---|---|---|
| 527643 | 7/1956 | Canada | 66/24 |
| 2326516 | 4/1977 | France | 66/24 |
| 620519 | 8/1978 | U.S.S.R. | 66/111 |

*Primary Examiner*—Wm. Carter Reynolds

*Attorney, Agent, or Firm*—Pearne, Gordon, Sessions, McCoy & Granger

[57] ABSTRACT

An air blast is utilized to close the latch of a dial needle carrying a loose loop of yarn on its shank portion. Such latch closing precludes possible snagging of the needle hook on the loose loop as it is cast off. The air blast does not directly impinge the needle or its latch but, rather, is directed away from the hook end of the needle along the longitudinal axis of the needle, wherein a low pressure area is created generally at the hook of the needle, an inrush of air to fill such low pressure area flipping the latch of the needle to a closed position. Such method of latch closing finds particular use in the circular rib knitting of cotton or wool yarn during the transfer of a loose loop from a dial needle to an associated cylinder needle.

4 Claims, 5 Drawing Figures

AIR-CONTROLLED NEEDLE LATCH CLOSING FOR KNITTING MACHINE

BACKGROUND OF THE INVENTION

The invention relates in general to latch needles used in knitting machines, and in particular to a method of closing dial needle latches to ensure transfer of a loose loop of yarn from the shank portion of the dial needle to an associated cylinder needle.

The invention finds particular use in the circular rib knitting of non-stretch yarns of cotton or wool wherein a non-shank hugging loose loop, spaced from the latch side of the dial needle, cannot be relied on to flip the open dial needle latch to a closed position as the dial needle is withdrawn through the loose loop. If an attempt is made to withdraw an open latch dial needle through a loose loop about its shank portion, the exposed hook of the dial needle may snag the loose loop even though the spoon portion of the open latch clears the loose loop on its withdrawal, thus resulting in a knitting defect.

While mechanical abutments, fingers, or the like could be utilized to close the latches of the dial needles, the severe space constraints in the needle area of a circular rib knitting machine would most probably preclude the successful use of mechanical latch closing means.

The use of non-mechanical means for effecting latch movement, such as use of an air blast, is illustrated by U.S. Pat. Nos. 2,658,366 and 4,033,149. While these patents disclose the use of air flow to move needle latches, they do not deal with the problem of loose loop transfer of non-stretch yarn as noted above.

SUMMARY OF THE INVENTION

The present invention provides a method particularly adapted to effect the positive closing of a latch-type needle carrying on its shank portion a loose loop of yarn about to be cast off. With the open latch needle in a clear position, a blast of air is utilized to flip the needle latch to a closed position prior to the withdrawal of the latch needle through a loose loop of yarn carried on its shank portion. Preferably, the blast of air is directed away from the open latch of the needle to create a low pressure area generally adjacent the latch wherein an inrush of air to fill the low pressure area impinges upon the latch and flips it to a closed position. The latch closing method of the present invention provides reliable latch needle closing especially in the environment of the circular rib knitting of non-stretch yarns of cotton or wool.

DETAILED DESCRIPTION OF THE PREFERRED EMBODIMENT

Figure 1:
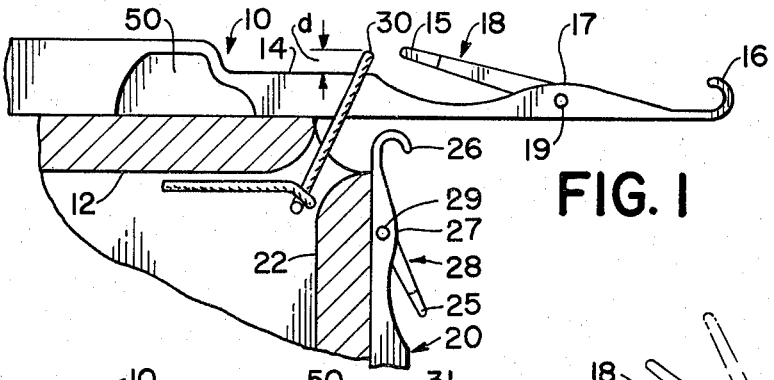
FIG. 1 illustrates an open latch dial needle and an associated cylinder needle, the dial needle carrying a loose loop of yarn about its shank portion.

With particular reference to FIG. 1, there is illustrated a latch-type dial needle 10, slidably movable in a horizontal direction. The dial needle 10 is supported by a dial plate 12 which extends generally perpendicularly relative to a vertically extending needle cylinder 22, which carries an associated latch-type cylinder needle 20, slidably movable in a vertical direction in cooperation with movement of the dial needle 10, as is well known in the art.

The dial and cylinder latch needles 10, 20 respectively include needle shank portions 14, 24, needle hooks 16, 26, cheek portions 17, 27, and movable latches 18, 28. The distal ends of each latch provide spoon portions 15, 25, with the other ends of the latches 18, 28 being pivotally mounted to the center area of the cheek portions 17, 27 by hinge rivets 19, 29. The hinged latches 18, 28 freely swing between an open position as illustrated in FIG. 1, and a closed position as illustrated in FIG. 3.

The dial needle 10 is shown in FIG. 1 as carrying on its shank portion 14 a loose loop 30 of yarn of, for example, non-stretch wool or cotton. It may be seen that the loop end on the latch side of the dial needle 10 is spaced by a distance d away from the needle. Such a loose loop condition is experienced particularly in the circular rib knitting of non-stretch yarn. Since the loose loop 30 does not hug the shank portion 14 of the dial needle, it cannot be relied upon to effectively flip the latch 18 of the dial needle 10 to a closed condition as illustrated in FIG. 3 as the dial needle is withdrawn through the loose loop for transfer to the associated cylinder needle 20.

Figure 2:
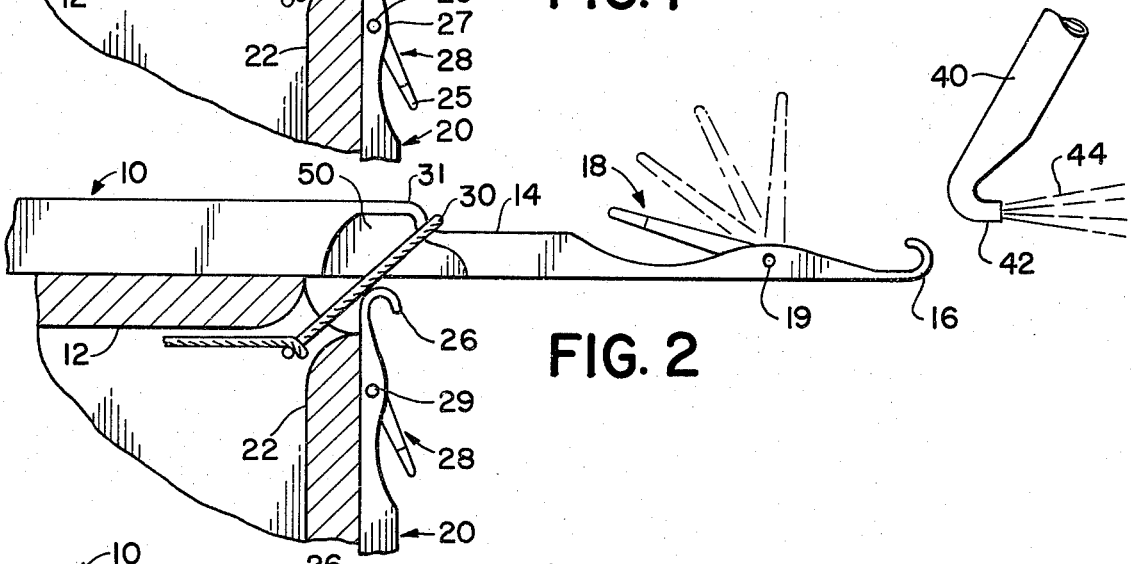
FIG. 2 illustrates the dial needle moved to its clear position and adjacent an air blast nozzle which effects closing of the latch of the dial needle.

FIG. 2 illustrates the closing of the latch 18 of the dial needle 10 wherein the open latch dial needle 10 is moved outwardly away from the cylinder needle 18 to a clear position wherein the loose loop 30 catches and is held taut by a loop-engaging needle portion 31. With the needle 10 held at the clear position as illustrated in FIG. 2, an air blast 44 provided by a nozzle 42 fed by a pneumatic conduit 40 flips the latch 18 toward a closed position as illustrated in phantom. Preferably, the blast of air is directed away from the open latch 18 of the needle to create a low pressure area generally adjacent the latch wherein an inrush of air to fill the low pressure area impinges the open latch and flips it to a closed position. As illustrated in FIG. 2, the blast of air 44 does not impinge on the needle itself but, rather, is generated at a point spaced from the hook 16 of the needle 10, the generation point being located generally along the needle's longitudinal axis, as illustrated. While the air blast 44 could be directed in numerous directions relative to the hook of the needle to provide the necessary low pressure area for flipping the latch 18 to a closed position, it has been found that highly reliable latch closing can be effected where the air blast is directed generally along the longitudinal axis of the dial needle.

Figure 3:
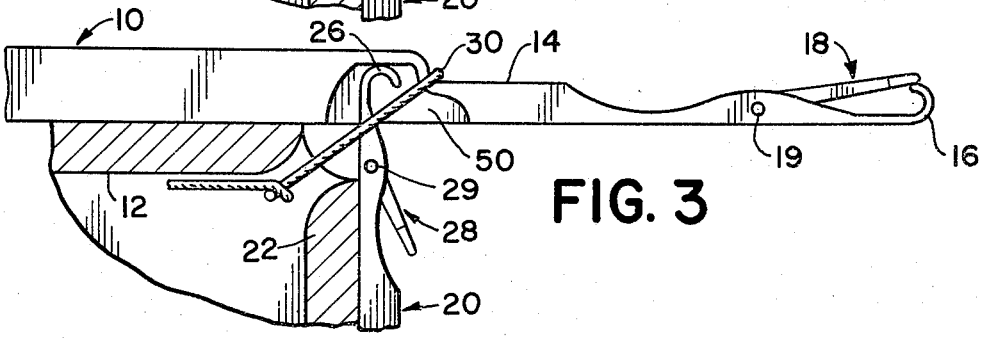
FIG. 3 illustrates the upward movement of the associated cylinder needle through the open loop of yarn carried on the shank portion of the dial needle.

Turning to FIG. 3, the dial needle 10, with its latch 18 in a closed condition, is held at the clear position while the hook end 26 of the cylinder needle 20 is moved toward the dial needle, as illustrated, and is inserted through the taut loop 30 carried on the shank portion of the dial needle, the hook 26 being received in a cylinder hook recess 50 provided by the dial needle 20. Upon conventional axial twisting of the cylinder needle on its longitudinal axis, the cylinder needle is able to ride out of the recess 50 and continue upwardly as the dial needle 10 begins its withdrawal through the loose loop 30, as illustrated in FIG. 4.

Figure 4:
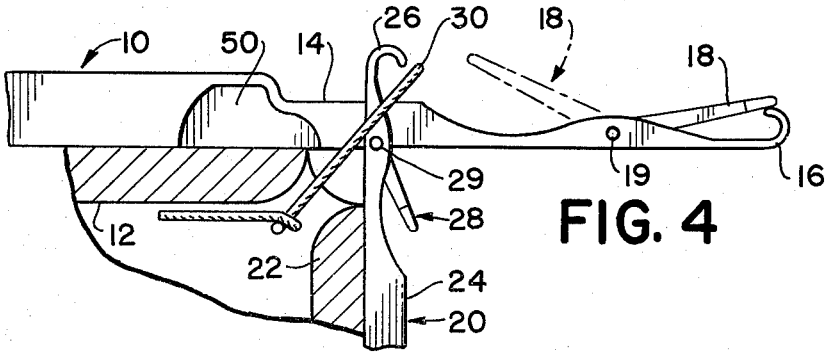
FIG. 4 illustrates the withdrawal of the dial needle through the loose loop and the continued upward movement of the cylinder needle.
Figure 5:
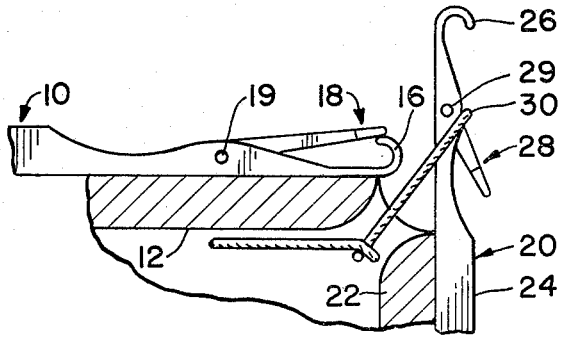
FIG. 5 illustrates complete withdrawal of the dial needle through the loose loop transferred to the cylinder needle.

In FIG. 4, the latch 18 is illustrated in phantom at its open position. It may be seen that the no longer taut, loose loop 30 is spaced above the latch side of the dial needle 10, wherein the spoon of the latch 18 could be successfully withdrawn through the loop 30 while the open hook 16 of the dial needle 10 may snag the loose loop 30 should it move downwardly toward the dial needle 10 after having cleared the latch 18. When the latch 18 is moved to a closed position, as illustrated in FIG. 4, the hook 16 is effectively protected from engagement with the loose loop 30, wherein the dial needle 10 is fully withdrawn through the loose loop 30, as illustrated in FIG. 5, the loose loop 30 being held in a relatively fixed position relative to the withdrawing dial needle 10 by the cylinder needle 20, which, as illustrated in FIG. 5, carries the transferred loose loop for a subsequent knitting operation.

The use of a remotely located air blast nozzle for generating a low pressure area at the hook-in of the needle to cause flipping of its open latch to a closed position has been found to be particularly effective for use in the space constrained environment of circular rib knitting.

Although a preferred embodiment of this invention has been shown and described, it should be understood that various modifications and rearrangements of the parts may be resorted to without departing from the scope of the invention as disclosed and claimed herein.

What is claimed is:

1. A method of closing the open latch of a latch needle, comprising the steps of moving the latch needle to a clear position, and thereafter directing a blast of air away from the open latch of the needle to create a low pressure area generally adjacent the latch wherein an inrush of air to fill the low pressure area impinges the open latch and flips it to a closed position, the blast of air not impinging the needle.

2. A method according to claim 1, including generating the air blast at a point spaced from the hook of the needle, the point being located generally along the longitudinal axis of the needle.

3. A method according to claim 2, including directing the air blast away from the hook of the needle along the longitudinal axis of the needle.

4. A method of transferring a loose loop of yarn from the shank portion of a dial needle to an associated cylinder needle comprising:

moving the dial needle to a clear position, the dial needle carrying a loose loop of yarn generally on its shank portion, the latch of the dial needle being in an open condition;

directing a blast of air away from the hook of the dial needle along its longitudinal axis, the blast of air not impinging the needle, the blast of air creating a low pressure area generally at the hook of the dial needle wherein an inrush of air to fill the low pressure area impinges the open dial needle latch and flips it to a closed condition, the air blast being generated at a point spaced from the hook of the dial needle;

moving the cylinder needle towards the dial needle, the hook end of the cylinder needle being inserted through the loose loop on the shank portion of the dial needle, the cylinder needle moving through the loose loop; and withdrawing the closed latch dial needle completely through the loose loop carried on the dial needle shank, the loose loop being held in a generally fixed position by the cylinder needle during withdrawal of the dial needle, the loose loop being transferred from the dial needle to the cylinder needle.

* * * * *